US006578344B1

(12) United States Patent
Fluck

(10) Patent No.: US 6,578,344 B1
(45) Date of Patent: Jun. 17, 2003

(54) APPARATUS FOR CHARGING TUBULAR CANISTERS WITH A STACK OF FLAT, DISK-SHAPED ITEMS, PARTICULARLY POTATO CHIPS

(75) Inventor: René Fluck, Schleitheim (CH)

(73) Assignee: SIG Pack Systems AG, Beringen (CH)

( * ) Notice: Subject to any disclaimer, the term of this patent is extended or adjusted under 35 U.S.C. 154(b) by 0 days.

(21) Appl. No.: 09/531,334

(22) Filed: Mar. 20, 2000

(30) Foreign Application Priority Data

Mar. 18, 1999 (CH) ..... 0506/99

(51) Int. Cl.[7] ..... B65B 1/04

(52) U.S. Cl. ..... 53/254; 53/247; 53/250; 53/253; 53/255; 53/258; 53/147; 53/272; 53/447; 53/532; 53/542

(58) Field of Search ..... 53/254, 255, 258, 53/250, 253, 244, 245, 443, 447, 475, 147, 531, 532, 542, 543, 272, 273, 276, 247

(56) References Cited

U.S. PATENT DOCUMENTS 4,052,838 A 10/1977 Hilton et al.

*Primary Examiner*—Eugene Kim
*Assistant Examiner*—Christopher Harmon
(74) *Attorney, Agent, or Firm*—Venable LLP; Robert Kinberg

(57) ABSTRACT

An apparatus for charging tubular canisters in a charging direction with a stack of face-to-face oriented flat items, includes a conveyor for supporting and positioning an item stack thereon; a canister holder for supporting and positioning a canister; an arrangement for advancing the item stack in an item feeding direction from the conveyor into the canister positioned by the canister holder; an elongated guide member movable parallel to the feeding direction for introduction into and withdrawal from the canister positioned by the canister holder; a holding plate supported at an end of the guide member and being pivotal into a first position in which it projects into a feed path of the item stack for engaging a leading item of the item stack and into a second position in which it is clear of the feed path; and a drive for moving the guide member parallel to the feeding direction and for rotating the holding plate into the first and second positions.

12 Claims, 2 Drawing Sheets

3
6
9
18
19
21
23
24
25
26
27
28
29

APPARATUS FOR CHARGING TUBULAR CANISTERS WITH A STACK OF FLAT, DISK-SHAPED ITEMS, PARTICULARLY POTATO CHIPS

CROSS REFERENCE TO RELATED APPLICATION

This application claims the priority of Swiss Application No. 506/99 filed Mar. 18, 1999, which is incorporated herein by reference.

BACKGROUND OF THE INVENTION

U.S. Pat. No. 4,052,838 discloses an apparatus for packaging stacks of face-to-face-arranged disk-shaped items, such as potato chips, in tubular packaging containers (canisters). A continuous stream of items is advanced on a downwardly sloping pivotal trough, and item stacks are formed by means of two plungers which are disposed above the trough and which are alternatingly raised and lowered. A separated stack slides into one of a plurality of star-like arranged tubes forming a rotary holder. As soon as a tube is filled, the rotary holder is advanced one step about a horizontal axis. In a subsequent station a canister which has a closed bottom at one end, is inserted over the filled tube. Upon further rotation of the holder the canister, filled with the items from the tube, is deposited in an upright orientation onto a removing conveyor.

Since the items are first loaded into a tube and the canister is inserted over the tube, the canister must have a greater diameter than necessary for receiving the items. As the stack of items slides into the tube, the leading items of the stack are likely to tilt which leads to operational disturbances because the entire stack no longer fits into the tube. Such an occurrence furthermore causes underweight packages which must be eliminated as waste.

SUMMARY OF THE INVENTION

It is an object of the invention to provide an improved apparatus of the above-outlined type from which the discussed disadvantages are eliminated.

This object and others to become apparent as the specification progresses, are accomplished by the invention, according to which, briefly stated, the apparatus for charging tubular canisters in a charging direction with a stack of face-to-face oriented flat items, includes a conveyor for supporting and positioning an item stack thereon; a canister holder for supporting and positioning a canister; an arrangement for advancing the item stack in an item feeding direction from the conveyor into the canister positioned by the canister holder; an elongated guide member movable parallel to the feeding direction for introduction into and withdrawal from the canister positioned by the canister holder; a holding plate supported at an end of the guide member and being pivotal into a first position in which it projects into a feed path of the item stack for engaging a leading item of the item stack and into a second position in which it is clear of the feed path; and a drive for moving the guide member parallel to the feeding direction and for rotating the holding plate into the first and second positions.

DESCRIPTION OF THE PREFERRED EMBODIMENTS

Figure 1:
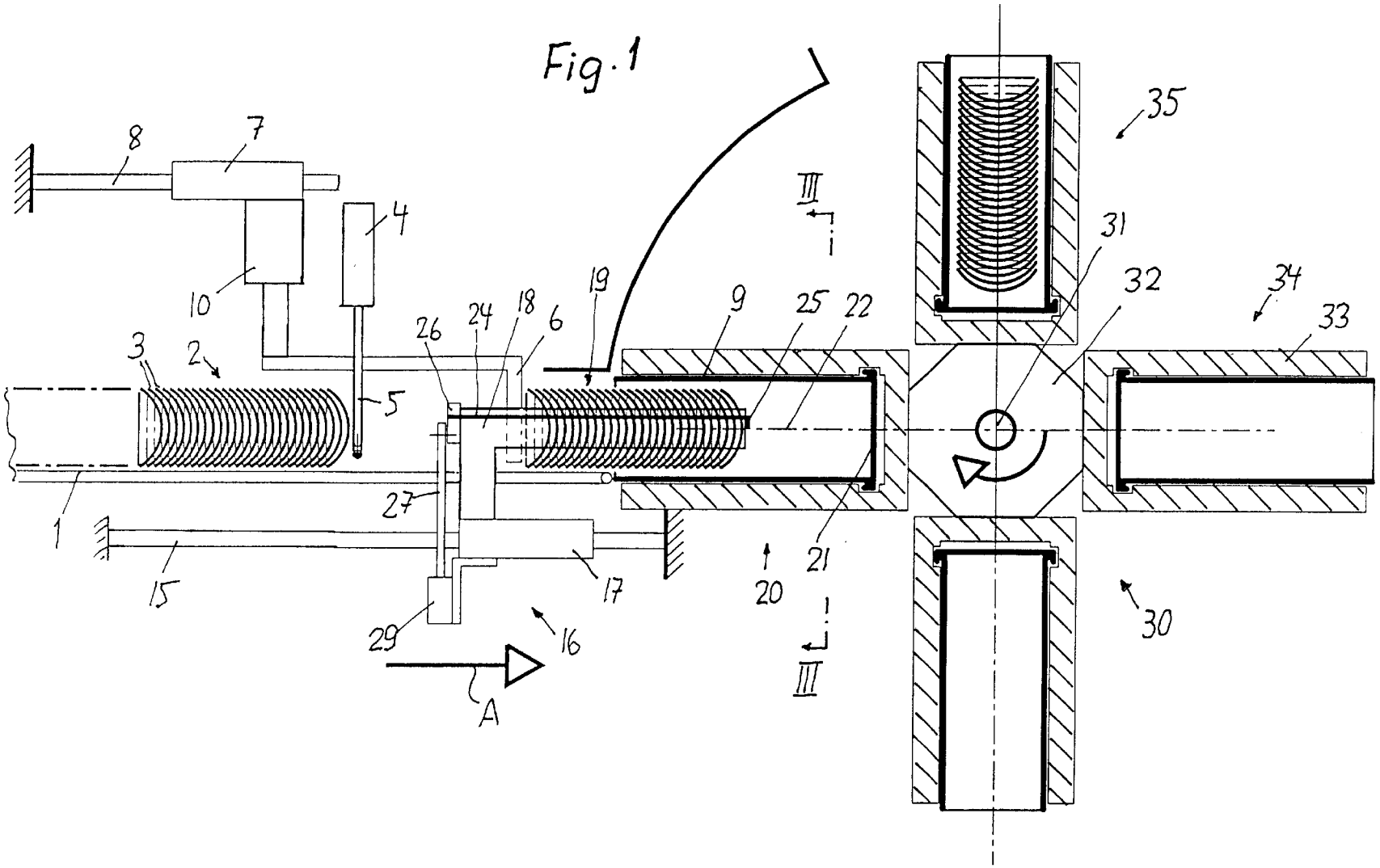
FIG. 1 is a partially sectional side elevational view of a preferred embodiment of the invention.
Figures 2, 3A, 3B, 3C:
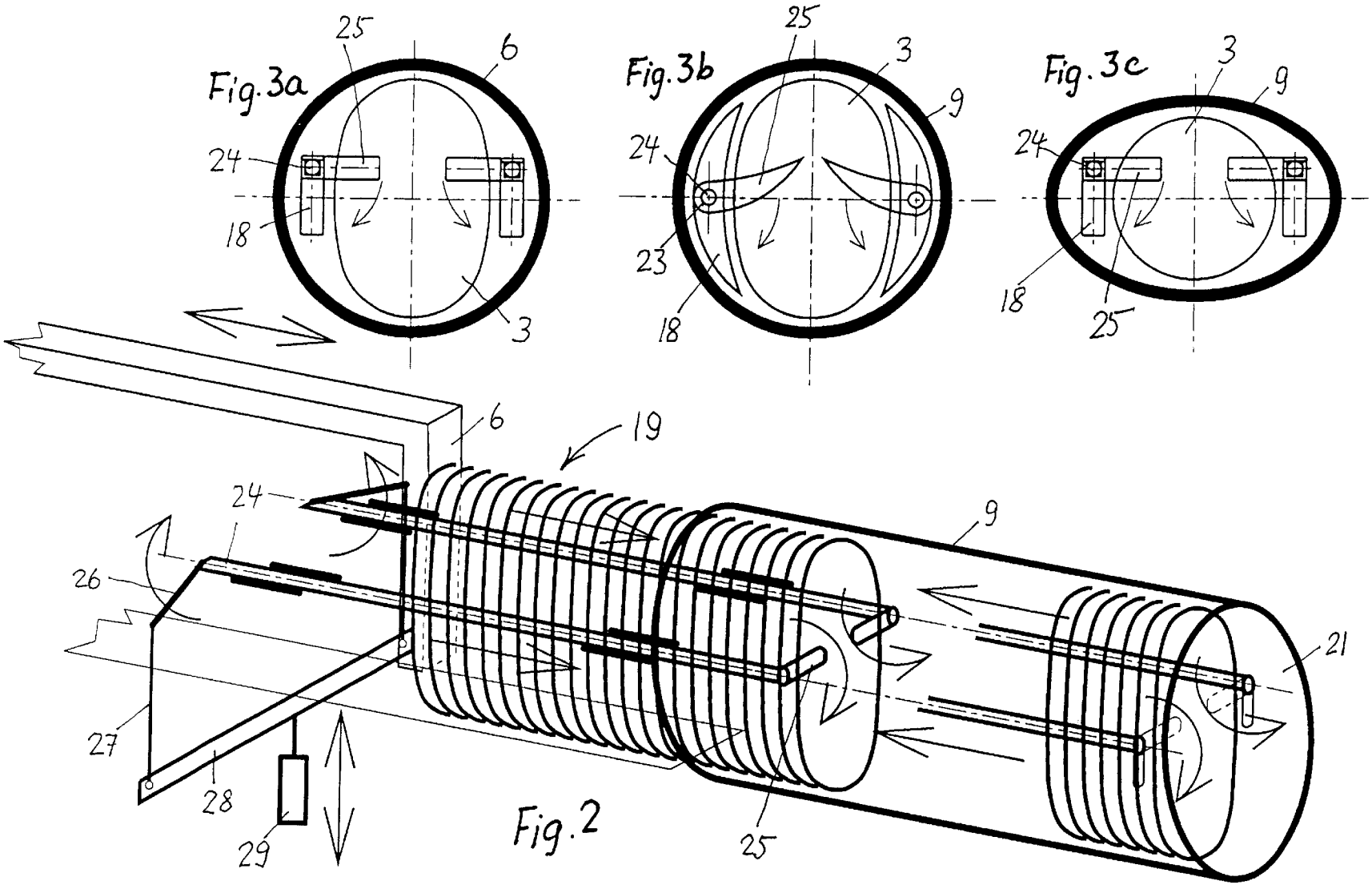
FIG. 2 is a schematic perspective view of one part of the preferred embodiment.
FIGS. 3*a* and 3*b* are schematic sectional views taken along line III—III of FIG. 1, illustrating two variants.
FIG. 3*c* is a view similar to FIG. 3*a*, showing, however, differently shaped items and canister.

Turning to FIGS. 1 and 2, a string 2 of face-to-face-engaging, edgewise standing, disk-shaped items 3, for example, potato chips, are advanced horizontally on a conveyor belt 1 in a direction designated by the arrow A. The string 2 is withheld by a separating blade 5 which is movable vertically by a linear motor 4. A pusher 6 is movable along a guide 8 by means of a linear motor 7 parallel to the conveying direction A between a first position in which it is situated in alignment with the blade 5 and a second position in which it is immediately adjacent the open end of a tubular canister 9. The pusher 6 is also vertically movable by means of a further linear motor 10.

A carriage 16 is displaceable by a linear motor 17 on a guide bar 15 oriented parallel to the conveying direction A. On the carriage 16 two rod-shaped guides 18 are mounted which are situated at opposite sides of the separated stack 19 of items 3 and which may be pushed into the canister 9 in the item-charging station 20 up to the canister bottom 21. Cylindrical bars 24 are axially rotatably supported in respective longitudinal bores 23 which are provided in the guides 18 and which are situated externally of the horizontal mid plane 22 of the item stack 19. A small holding plate 25 is rigidly connected to each bar 24 at its frontal (leading) end and is oriented perpendicularly thereto, and a lever 26 is attached to the rearward end of each bar 24. The free ends of the two levers 26 are connected with a common transverse rod 28 by means of respective link rods 27. The transverse rod 28 is movable vertically by means of a further linear motor 29 mounted on the carriage 16. By virtue of this arrangement, the two holding plates 25 may be moved from their first position which is shown in FIGS. 3*a*, 3*b* and 3*c* and in which they extend into the outline of the stack 19 (that is, into the path of motion thereof), into a second position in which they are at least partially in alignment with the cross section of the guides 18, as viewed in the direction A.

The outline of the items (potato chips) 3 is generally oval as shown in FIGS. 3*a* and 3*b*. Upon filling a canister 9 of circular cross section with edgewise oriented items 3, there is therefore sufficient place provided bilaterally of the stack 19 for the guides 18 to penetrate into the canister 9 together with the item stack 19. The items (such as potato chips) 3 may be, for example, cylindrically bent as shown in FIG. 1 or may be of saddle-shaped bent configuration.

The canisters 9 are advanced to the filling station 20 by means of a conveying device 30. In the shown embodiment, the conveying device 30 is formed as a star wheel which includes a hub 32 rotatable in steps of 90° about a horizontal axis 31 oriented transversely to the conveying direction A. The star wheel further has sockets 33 secured in a radial orientation to the hub 32 in a uniform circumferential distribution. Each socket 33 is adapted to receive respective canisters 9 whose longitudinal axes will thus be oriented radially to the axis 31. In a charging station 34 an empty canister 9 is pushed into the respective socket 33 from the side by means of a non-illustrated plunger. In the filling (item-charging) station 20 the item stack 19 is introduced into the respective canister 9. In a subsequent canister-discharge station 35 the filled canister 9 is pushed out of the socket 33 onto a conveyor belt by means of a further plunger.

In the description which follows, the operation of the above-described apparatus will be set forth.

In the starting position the separating blade 5 is lowered and arrests the item string 2 in its progress. The pusher 6 is raised and withdrawn into alignment with the blade 5. The holding plates 25 are pivoted into the position shown in 3*a*, 3*b* and 3*c*, and the carriage 16 is withdrawn to such an extent that the plates 25 just about engage the leading item 3 of the item string 2.

Thereafter, the blade 5 is raised and the carriage 16 is displaced in the conveying direction A to the item stack 19. In this position motors 4 and 10 are simultaneously actuated so that the blade 5 and the pusher 6 are lowered into the item string 2 and separate a stack 19 therefrom. Subsequently, the pusher 6 and the carriage 16 are jointly shifted in the conveying direction A until the holding plates 25 have reached the bottom 21 of the canister 9. The holding plates 25 are pivoted clear of the cross-sectional outline of the item string 2 by means of the motor 29 and the carriage 16 is moved back into the basic position. The star wheel assembly composed of the hub 32 and the sockets 33 is rotated 90° and the pusher 6 moves back into its initial position.

After pivoting back the holding plates 25 into their position shown in FIGS. 3*a*–3*c*, a new filling cycle begins during which the previously filled canister 9 is pushed out of the socket 33 in the discharge station 35 and a new canister 9 is pushed into the respective socket 33 in the loading station 34.

As shown in FIG. 3*b*, the bar-like guide components 18 may be of sickle-shaped configuration. This makes possible a particularly satisfactory guidance of the stack 19 since the inner face of the components 18 substantially conforms to the outline of the items. The bars 18, however, may be omitted altogether and the rods 24 themselves may be used as guide components. Instead of the linear motors 4, 7, 17 and 29, other driving mechanisms such as pneumatic cylinder assemblies may be used. For the driving assemblies 7 and 17, however, linear motors are preferred because they make possible a simpler synchronization of motion. In case the separating blade 5 is arranged immediately at the open side of the canister 9, under certain circumstances the pusher 6 and its function may be omitted.

The described apparatus makes possible an operationally reliable filling of the canisters 9. A tilting of the leading items 3 during insertion is avoided, and the items 3 are handled in a gentle manner. By directly charging the canisters (rather than with the intermediary of a charging tube), the frictional stress on the items is reduced. The apparatus is of simple construction and makes possible a charging of item stacks from a horizontal item string 2 without reorientation which would be particularly problematic in case of potato chips because such reorientations (deflections) may cause disturbances in the stack formation. The filled canisters are less voluminous than, for example, bags containing loosely packed potato chips, because the chips are accommodated in the canister in a well-organized stack. Since the inner diameter of the canister 9 need only be slightly larger than the longitudinal dimension of the oval articles 3, the packaging volume is minimized, and significantly less damage during transportation occurs.

It will be understood that the above description of the present invention is susceptible to various modifications, changes and adaptations, and the same are intended to be comprehended within the meaning and range of equivalents of the appended claims.

What is claimed is:

1. An apparatus for charging tubular canisters in an item feeding direction with a stack of face-to-face oriented items, the items being stacked such that their faces are perpendicular to the feeding direction, and a direction of stacking is parallel to the feeding direction, the apparatus comprising:

(a) a conveyor for supporting and positioning an item stack thereon;

(b) a canister holder for supporting and positioning a canister; said canister holder adjoining an outlet end of said conveyor;

(c) means for advancing the item stack in the feeding direction from the conveyor into the canister positioned by said canister holder;

(d) an elongated guide member movable parallel to said feeding direction for introduction into and withdrawal from the canister positioned by said canister holder; said elongated guide member having a frontal end that is a leading end when the elongated guide member is introduced into the canister in said feeding direction;

(e) a holding plate supported at said frontal end of said guide member and being pivotal into a first position in which it projects into a feed path of the item stack for engaging a leading item of the item stack and into a second position in which it is clear of said feed path, wherein said guide member comprises two parallel-spaced guide bars extending on either side of said feed path parallel to said feeding direction for straddling the item stack located in said feed path; the frontal end of the guide member being a frontal end of each guide bar; each guide bar carrying, at the frontal end thereof, a respective said holding plate; and (f) drive means for moving said guide member parallel to said feeding direction and for rotating said plate into said first and second positions.

2. The apparatus as defined in claim 1, wherein said drive means comprises a drive bar having a longitudinal axis; said drive bar carrying said holding plate and being rotatable about said drive bar axis, said holding plate being oriented at least approximately perpendicularly to said drive bar axis.

3. The apparatus as defined in claim 2, wherein said drive bar is rotatably supported in said guide member.

4. The apparatus as defined in claim 2, in combination with an item stack supported in a horizontal orientation on said conveyor; said item stack having a horizontal central plane; said drive bar being situated externally of said plane.

5. The apparatus as defined in claim 1, wherein said guide member has a cross-sectional area and further wherein said holding plate is, as viewed in said feeding direction, at least in a partial alignment with said area when said holding plate is in its said second position.

6. The apparatus as defined in claim 1, wherein said guide member has a sickle-shaped cross section.

7. The apparatus as defined in claim 1, wherein said means for advancing the item stack comprises a pusher for contacting a trailing item of the item stack; said drive means comprising means for moving said pusher parallel and transversely to said feeding direction.

8. The apparatus as defined in claim 1, wherein the items are situated on said conveyor in an item string of indefinite length; further comprising a separating blade movable transversely to said feeding direction for separating an item stack from the item string.

9. The apparatus as defined in claim 1, wherein said drive means includes a linear motor and a mechanical crank connected to said linear motor and said holding plate for rotating said holding plate.

10. The apparatus as defined in claim 1, wherein said canister holder comprises a rotatable star wheel assembly including a hub having a rotary axis and a plurality of sockets mounted in a radial orientation on said hub and being circumferentially uniformly distributed thereabout.

11. The apparatus as defined in claim 1, wherein each of said two parallel-spaced guide bars supports one side of a single item stack.

12. The apparatus as defined in claim 1, wherein each said guide bar has a longitudinal axis, and wherein said respective said holding plate pivots about an axis parallel to the longitudinal axis of said guide bar.

* * * * *